United States Patent [19]

McCleerey

[11] Patent Number: 4,954,100

[45] Date of Patent: Sep. 4, 1990

[54] RIBBON CROSSOVER CABLE ASSEMBLY AND METHOD

[75] Inventor: Earl W. McCleerey, Mechanicsburg, Pa.

[73] Assignee: AMP Incorporated, Harrisburg, Pa.

[21] Appl. No.: 444,504

[22] Filed: Dec. 1, 1989

[51] Int. Cl.[5] ..... H01R 9/07

[52] U.S. Cl. ..... 439/492; 439/502; 172/117 F; 29/857

[58] Field of Search ..... 439/492–499, 439/67, 77, 638, 651, 655, 719; 174/117 R, 117 F, 117 FF; 29/857

[56] References Cited

U.S. PATENT DOCUMENTS

| | | | |
|---|---|---|---|
| 3,705,378 | 3/1971 | Elkins | 339/156 R |
| 3,818,122 | 6/1974 | Luetzow | 174/117 FF |
| 4,065,199 | 12/1977 | Andre et al. | 439/498 |
| 4,068,912 | 1/1978 | Hudson, Jr. | 339/99 R |
| 4,290,664 | 9/1981 | Davis et al. | 439/638 |
| 4,410,229 | 9/1982 | Stephenson | 339/98 |
| 4,557,543 | 3/1985 | McCleery et al. | 339/97 P |
| 4,618,196 | 10/1986 | Muzslay | 439/638 |
| 4,781,615 | 8/1987 | Davis et al. | 439/395 |

*Primary Examiner*—David Pirlot
*Attorney, Agent, or Firm*—David L. Smith

[57] ABSTRACT

A ribbon crossover cable assembly (10) and method provides for longitudinally splitting a first ribbon cable (12) between a centrally located pair (22) of conductors (14) through a limited segment (24) of the first ribbon cable (12) thereby forming an opening (26). The first end (18) of the first ribbon cable (12) is passed through the opening (26) such that the first end (18) of the first ribbon cable (12) is looped through opening (26). An end (30) of a second ribbon cable (28) is passed through the opening (26) and connectors (34,36) are terminated to the ends (18,30;20,32) of the cables (12,28).

9 Claims, 3 Drawing Sheets

RIBBON CROSSOVER CABLE ASSEMBLY AND METHOD

BACKGROUND OF THE INVENTION

The present invention relates to providing a ribbon crossover cable assembly and method for electrically commoning corresponding ones of the contacts in a pair of electrical connectors.

When connectors are positioned one above another, such as on the back panel of an electrical device, and it is desired to have the same input or output points available on corresponding ones of the contacts of the connectors, the contacts of the connectors are wired in parallel. When each contact has a cable terminating portion of portion positioned in a single array spanning the width of a ribbon cable, with the terminating portion of contacts spaced substantially as the centerline spacing of conductors in the ribbon cable, the ribbon cable can conveniently be terminated to both connectors interconnecting corresponding ones of the contacts in the two connectors. Some prior art connectors of this type are disclosed in U.S. Pat. Nos. 3,820,055; 4,068,912; 4,241,970; and 4,410,229, the disclosures of which are hereby incorporated by reference.

However when the contacts of a connector have cable terminating portions that are not so conveniently spaced, such as the connectors disclosed in U.S. Pat. Nos. 4,243,288; 4,557,543; and 4,781,615, the disclosures of which are hereby incorporated by reference, where the contact cable terminating portions are positioned in two rows, interconnecting corresponding ones of the contacts of two connectors positioned one above the other is not as convenient.

When two ribbon cables, one for each row of contacts, are used to interconnect corresponding ones of the contacts in these latter type of connectors, the cables must cross over each other to interconnect the lower row of contacts in the lower connector with the lower row of contacts in the upper connector and the upper row of contacts in the lower connector with the upper row of contacts in the upper connector. One such method of providing a crossover using two flat cables provides a 45° bend in a first one of the flat cables to cause the conductors to form a right angle. The first ribbon cable is then folded over an edge of the second ribbon cable with a second 45° bend reorienting the conductors axially in the same direction albeit on the opposite side of the second cable. This method results in the conductors of the folded (first) cable being longer than the conductors of the unfolded (second) cable by at least the width of the first ribbon cable. The difference in length of the conductors can effect electrical characteristics of the conductors and the resultant signals transmitted thereover. A longer length cable for example may increase resistance and cause an increased delay in the signal being transmitted over the longer cable as compared to the delay in a signal being transmitted over the shorter cables.

It would be desirable to have a cable assembly for interconnecting contacts on connectors having two arrays of contacts and positionable one above the other wherein the length of the two ribbon cables would be substantially the same.

SUMMARY OF THE INVENTION

A ribbon crossover cable assembly and method provides for longitudinally splitting a first ribbon cable between a centrally located pair of conductors through a limited segment of the first ribbon cable thereby forming an opening. The first end of the first ribbon cable is passed through the opening such that the first end of the ribbon cable is looped through the ribbon cable. An end of a second ribbon cable is passed through the opening and connectors are terminated to the ends of the two cables. This results in a ribbon crossover cable assembly having a first ribbon cable having conductors surrounded by insulation and defining first and second ends. The split defines an opening between a centrally located pair of conductors through a limited segment of the first ribbon cable. The first ribbon cable with the first end passed through the opening loops back through itself. A second ribbon cable having conductors surrounded by insulation and defining first and second ends has the first end thereof passing through the opening in the first cable with the ends of the second ribbon cable positioned proximate the ends of the first ribbon cable. The contacts of a first connector are terminated to respective ones of the conductors at the first ends of the first and second cables. Contacts of a second connector are terminated to respective ones of the conductors at the second ends of the first and second cables thereby resulting in a ribbon crossover cable assembly.

DESCRIPTION OF THE PREFERRED EMBODIMENT

Figure 5:
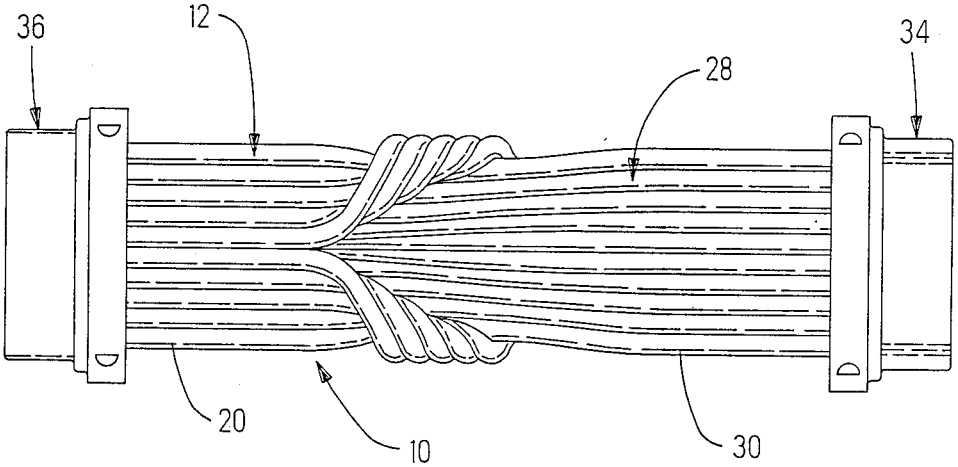
FIG. 5 shows connectors terminated to conductors of the pair of ribbon cables at respective ends thereof forming a cable assembly.

FIG. 5 shows connectors terminated to conductors of a pair of ribbon cables at respective ends thereof forming a ribbon crossover cable assembly 10, in accordance with the present invention. Cable assembly 10 is fabricated from a first ribbon cable 12 having conductors 14 surrounded by insulation 16 as is known in the art. Cable 12 is cut to a desired length defining respective first and second ends 18,20.

Figure 2:
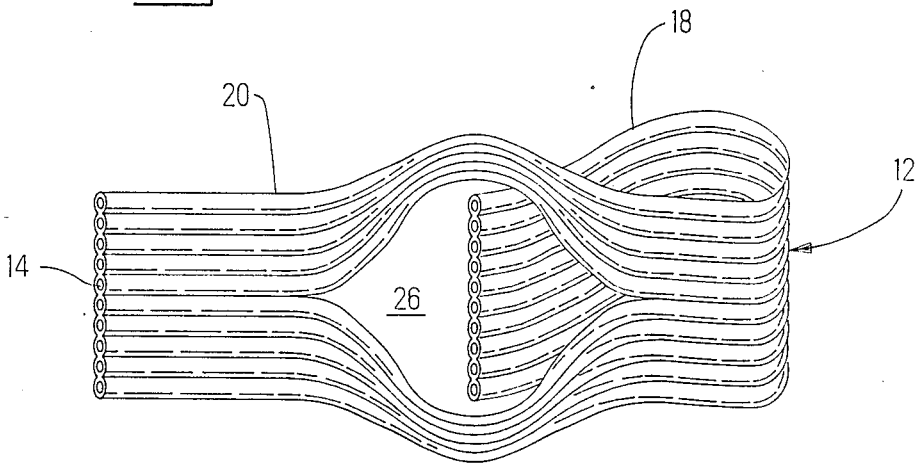
FIG. 2 is the ribbon cable of FIG. 1 having an end of the cable positioned to pass through the opening.
Figure 3:
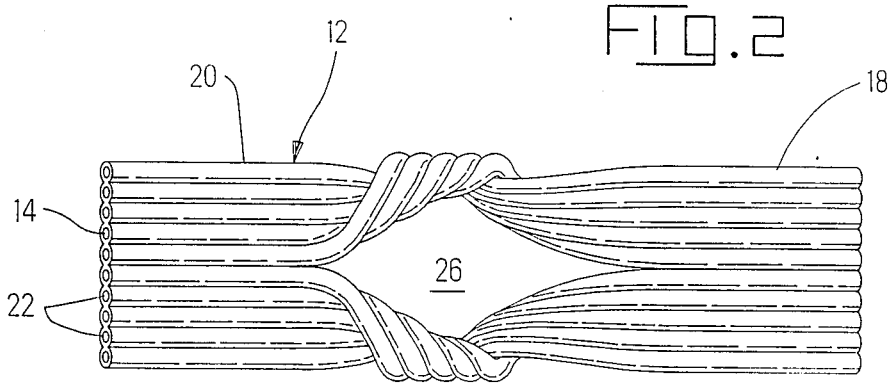
FIG. 3 is the ribbon cable of FIG. 2 with the end of the cable passed through the opening such that the cable is looped through itself forming an involute opening.

Insulation 16 separating a centrally located pair 22 of conductors 14 is longitudinally split through a limited segment 24 forming opening 26. For cables comprised of individual conductors that are intermittently bonded, splitting of the cable is not required. A pair of centrally located conductors may be separated through a loose section. As best seen in FIG. 2, first end 18 of cable 12 is folded back to pass through opening 26 with opening 26 inherently forming across the width of cable 12 to be substantially the width of cable 12. That portion of cable 12 between end 18 and opening 26 is pulled through opening 26 such that end 18 of cable 12 is looped through cable 12 as shown in FIG. 3. Cable 12 thus forms an involute with conductors 14 at the first end resuming their orientation and alignment with conductors 14 at the second end 20.

Figure 4:
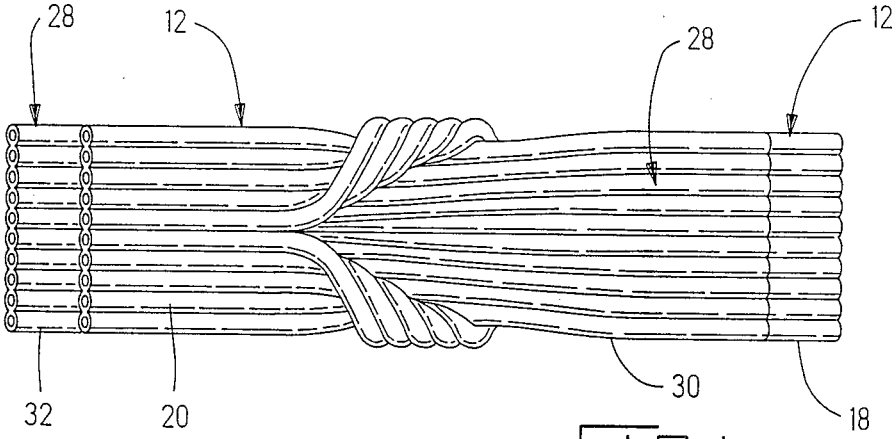
FIG. 4 shows a second ribbon cable passing through the opening in the ribbon cable of FIG. 3.

A second ribbon cable 28 of substantially the same desired length as cable 12 has conductors 14 surrounded by insulation 16 and defines respective first and second ends 30,32. The first end 30 of cable 28 is passed through opening 26 with the first and second ends 30,32 of cable 28 positioned proximate the first and second ends 18,20 of cable 12 as best seen in FIG. 4. Cable 28 to the left of opening 26 is beneath cable 12 while to the right of opening 26 cable 28 is on top of cable 12, the crossover being achieved by cable 28 having passed through opening 26 in cable 12. The reversal of cable positions is thus achieved with ease.

The ends of cables 12 and 28 are terminated to connectors as is known in the art. Conductors 14 at first ends 18 and 30 are terminated to respective contacts of a first connector 34. Conductors 14 at second ends 20,32 are terminated to respective contacts of a second connector 36. Connectors 34 and 36 are known connectors and may be of the type disclosed in U.S. Pat. Nos. 4,243,288; 4,557,543; and 4,781,615. In the preferred embodiment, connectors 34 and 36 are of the type disclosed in U.S. Pat. No. 4,781,615.

Figure 6:
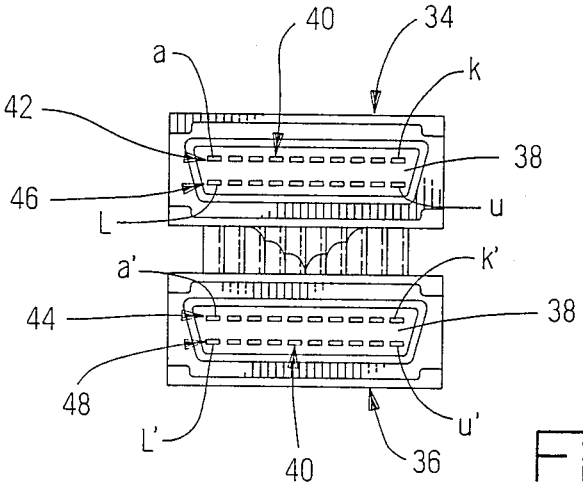
FIG. 6 shows a mating face view of the connectors at the ends of the cable assembly of FIG. 5.

FIG. 6 shows cable assembly 10 from the mating face 38 of connectors 34,36 with cables 12 and 28 folded into a "U" shape and connector 34 positioned over connector 36. Contacts 40 in connector 34 have been electrically commoned with corresponding contacts 40 in connector 36 by cables 12 and 28. Contacts 40 in position a through k in the upper row 42 of contacts 40 in connector 34 are commoned with contacts 40 in positions a' through k' in the upper row 44 of contacts 40 in connector 36. Contacts 40 in positioned l through u in the lower row 46 of contacts 40 in connector 34 are commoned with contacts 40 in positions l' through u' in the lower row 48 of contacts 40 in connector 36. Interconnecting contacts in connector 34 with corresponding contacts in connector 36 is thus easily and accurately achieved due to the reversal of cable positions as described above.

Figure 1:
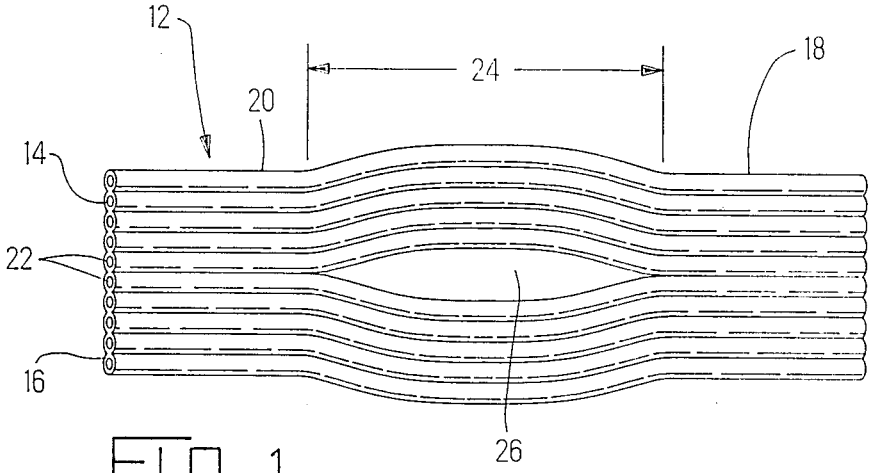
FIG. 1 is a ribbon cable having a split through a limited segment between a pair of centrally located conductors forming an opening.
Figure 7:
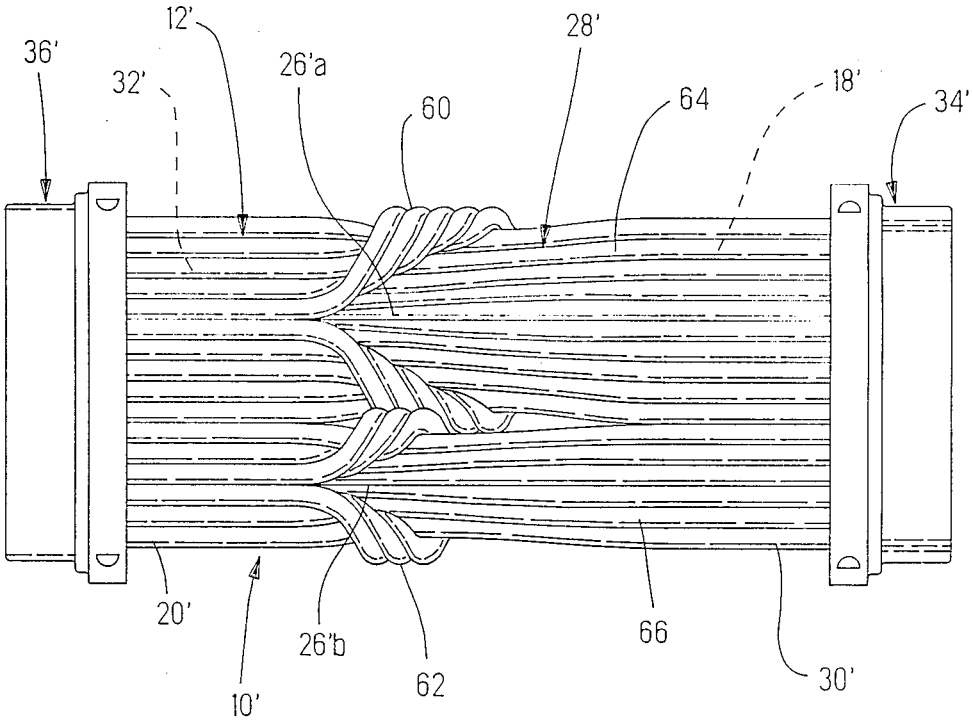
FIG. 7 shows how two involute formed openings may be used in a wide cable.

Wide cables may employ or require more than one involute formed opening 26' in the width, as shown in FIG. 7. A wide flat cable 12' is first split from first end 18' to proximate the location along the length where openings 26' will be made, forming segments 60,62. A wide second cable 28' is also split from first end 30 approximately the same distance as cable 12' forming segments 64,66. Segment 60 is split between a centrally located pair of conductors and is formed into an involute as described above with respect to FIGS. 1–3 forming opening *26'a*, with segment 64 passing therethrough. Segment 62 is also split through a limited segment between a pair of centrally located conductors and is formed into an involute as described above forming opening *26'b*, with segment 66 passing therethrough. Connector 34' is then terminated to respective first ends 18' and 30', with connector 36' terminated to respective second ends 20' and 32' forming cable assembly 10'.

One end of a single ribbon cable could be terminated to a connector with the other end split and formed into two segments one of which forms an involute and the other of which passes through the opening in the involute to achieve substantially the same ribbon crossover cable assembly.

While the connectors shown in FIG. 6 are both tab connectors, they could equivalently both be receptacle connectors, or equivalently could be one tab and one receptacle connector. Although the connectors shown in FIG. 6 have the same number of contacts in the upper and lower rows, the invention is not limited thereto.

I claim:

1. A ribbon crossover cable assembly, comprising:

a first ribbon cable, said first ribbon cable having conductors surrounded by insulation, first and second ends and an opening formed by a separation through a limited segment of said first ribbon cable between a centrally located pair of conductors, said first ribbon cable having said first end passed through the opening such that said first end is looped through said ribbon cable;

a second ribbon cable, said second ribbon cable having conductors surrounded by insulation and second ends, said first end passing through the opening in the first cable;

a first connector having contacts, said contacts terminated to respective ones of the conductors of the first and second cables at the first ends thereof; and a second connector having contacts, said contacts terminated to respective ones of the conductors of the first and second cables at the second ends thereof.

2. A ribbon crossover cable assembly as recited in claim 1, wherein the first and second cables have the same number of conductors.

3. A ribbon crossover cable assembly as recited in claim 1, wherein the contacts in said second connector are electrically commoned with respective ones of the contacts in the first connector.

4. A ribbon crossover cable assembly as recited in claim 1, wherein the first connector has the same number of contacts as the second connector.

5. A method of producing a ribbon crossover cable assembly, comprising the steps of:

longitudinally separating conductors of a first ribbon cable through a limited segment of the first ribbon cable between a centrally located pair of conductors forming an opening;

passing a first end of the first ribbon cable through the opening such that the first end of the ribbon cable is looped through the ribbon cable; and passing an end of a second ribbon cable through the opening.

6. A method as recited in claim 5, further comprising the step of terminating respective ends of the first and second cables to connectors.

7. A method as recited in claim 6, wherein the step of terminating respective ends of the first and second cables to connectors comprises:

terminating the first ends of the first and second cables to a first connector; and terminating the second ends of the first and second cables to a second connector.

8. A method of producing a ribbon crossover cable assembly, comprising the steps of:

longitudinally separating conductors of a first cable from a first end through a portion of its length, defining first and second segments in said first cable;

longitudinally separating a second cable from a first end through a portion of its length, defining first and second segments in said second cable;

longitudinally separating conductors of the first and second segments of the first ribbon cable through a limited segment of the first ribbon cable between a respective centrally located pair of conductors forming respective openings therein;

passing the first end or respective first and second segments through respective openings therein such that the first end of each segment passes through the respective opening in each segment; and passing a respective first end of the first and second segments of the second cable through respective openings in the first cable.

9. A method as recited in claim 8 further comprising the step of terminating respective ends of the first and second cables to connectors.

* * * * *